US010310396B2

(12) United States Patent
Kamikura et al.

(10) Patent No.: US 10,310,396 B2
(45) Date of Patent: Jun. 4, 2019

(54) METHOD OF PRODUCING TONER

(71) Applicant: CANON KABUSHIKI KAISHA, Tokyo (JP)

(72) Inventors: Kenta Kamikura, Yokohama (JP); Kunihiko Nakamura, Gotemba (JP); Maho Tanaka, Tokyo (JP); Fumiya Hatakeyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/974,936

(22) Filed: May 9, 2018

(65) Prior Publication Data

US 2018/0329322 A1 Nov. 15, 2018

(30) Foreign Application Priority Data

May 15, 2017 (JP) ..... 2017-096524
Apr. 3, 2018 (JP) ..... 2018-071287

(51) Int. Cl.
*G03G 9/08* (2006.01)
*G03G 9/087* (2006.01)
*G03G 9/097* (2006.01)

(52) U.S. Cl.
CPC ..... *G03G 9/0806* (2013.01); *G03G 9/0804* (2013.01); *G03G 9/087* (2013.01); *G03G 9/0812* (2013.01); *G03G 9/0825* (2013.01); *G03G 9/0827* (2013.01); *G03G 9/08773* (2013.01); *G03G 9/09775* (2013.01)

(58) Field of Classification Search
CPC ..... G03G 9/0806; G03G 9/0804; G03G 9/08773; G03G 9/0827; G03G 9/0825; G03G 9/09775; G03G 9/0812; G03G 9/087
See application file for complete search history.

(56) References Cited

U.S. PATENT DOCUMENTS 7,858,283 B2 12/2010 Ishigami et al.
7,927,775 B2 4/2011 Komatsu et al.
7,939,233 B2 5/2011 Inoue et al.
8,137,886 B2 3/2012 Baba et al.
8,142,972 B2 3/2012 Hotta et al.
8,288,069 B2 10/2012 Fujikawa et al.
8,828,639 B2 9/2014 Kamikura et al.
8,986,914 B2 3/2015 Fujikawa et al.
9,034,549 B2 5/2015 Shiotari et al.
9,256,148 B2 2/2016 Fujikawa et al.
9,261,806 B2 2/2016 Moribe et al.
9,285,697 B2 3/2016 Fukudome et al.
9,423,708 B2 8/2016 Tominaga et al.
9,529,289 B2 12/2016 Abe et al.
9,645,518 B2 5/2017 Abe et al.
9,829,820 B2 11/2017 Masumoto et al.
9,880,478 B2 1/2018 Shimano et al.
9,897,933 B2 2/2018 Yoshida et al.
9,921,501 B2 3/2018 Mochizuki et al.
9,952,523 B2 4/2018 Shimano et al.
2009/0246675 A1 10/2009 Nakamura et al.
2010/0028796 A1 2/2010 Nakamura et al.
2010/0183971 A1 7/2010 Fujikawa et al.
2015/0378275 A1* 12/2015 Abe ..... G03G 9/0806 430/137.13

FOREIGN PATENT DOCUMENTS

JP 2010-181439 A 8/2010
JP 2016-027396 A 2/2016
JP 2016-027399 A 2/2016

OTHER PUBLICATIONS

U.S. Appl. No. 15/969,318, Tsuneyoshi Tominaga, filed May 2, 2018.
U.S. Appl. No. 15/973,661, Kenta Kamikura, filed May 8, 2018.
U.S. Appl. No. 15/974,187, Sara Yoshida, filed May 8, 2018.
U.S. Appl. No. 15/974,917, Kunihiko Nakamura, filed May 9, 2018.
U.S. Appl. No. 15/974,928, Fumiya Hatakeyama, filed May 9, 2018.
U.S. Appl. No. 15/974,969, Maho Tanaka, filed May 9, 2018.
U.S. Appl. No. 15/975,064, Kunihiko Nakamura, filed May 9, 2018.
U.S. Appl. No. 15/975,305, Kentaro Yamawaki, filed May 9, 2018.

* cited by examiner

*Primary Examiner* — Thorl Chea
(74) *Attorney, Agent, or Firm* — Venable LLP

(57) ABSTRACT

A first aspect is a toner production method in which an organosilicon compound is condensed in a surfactant-containing aqueous medium with a specific surface tension, in which a resin particle is dispersed, to produce a toner having the condensate of the organosilicon compound on the surface of the resin particle, and a second aspect is a toner production method in which an organosilicon compound is condensed in an aqueous medium which has a surfactant and a specific metal salt and in which a resin particle is dispersed, to produce a toner having the condensate of the organosilicon compound on the surface of the resin particle.

14 Claims, No Drawings

METHOD OF PRODUCING TONER

BACKGROUND OF THE INVENTION

Field of the Invention

The present invention relates to a method of producing a toner that develops electrostatic images (electrostatic latent images) used in image-forming methods such as, for example, electrophotography and electrostatic printing.

Description of the Related Art

As the development of computers and multimedia has progressed, means have come to be required in recent years for the output of high-definition full-color images in a broad range of fields from the office to the home, and additional improvements in toner performance properties are thus required.

Within this sphere, toner having the condensate of an organosilicon compound on the toner particle surface has been investigated for the purpose of improving toner performance.

The first production method in Japanese Patent Application Laid-open No. 2016-027399 discloses a method for obtaining, by the suspension polymerization method, a toner having the condensate of an organosilicon compound on the toner particle surface. Specifically, a method is disclosed in which particles of a polymerizable monomer composition containing polymerizable monomer, colorant, and organosilicon compound are formed in an aqueous medium and a condensate of the organosilicon compound is formed in a surface layer on the toner particle by carrying out polymerization of the polymerizable monomer. This production method can provide, without particular problems, a toner having a condensate of the organosilicon compound on the toner particle surface.

On the other hand, Japanese Patent Application Laid-open No. 2010-181439 and the fourth production method in Japanese Patent Application Laid-open No. 2016-027399 disclose a method for obtaining, by the emulsion aggregation method, a toner having the condensate of an organosilicon compound on the toner particle surface. Japanese Patent Application Laid-open No. 2010-181439 discloses a toner production method that has a step of obtaining a core particle by carrying out filtration and washing on a core particle dispersion obtained by the emulsion aggregation method; a step of obtaining a dispersion by redispersing the obtained core particle in an aqueous medium; and a step of establishing a layer of a condensate of an organosilicon compound on the core particle surface by reacting a silane coupling agent in the resulting dispersion.

With the fourth method in Japanese Patent Application Laid-open No. 2016-027399, a method is disclosed in which binder resin particles, colorant particles, and organosilicon compound-containing resin particles in a sol or gel state are aggregated and associated in an aqueous medium to form a toner particle.

SUMMARY OF THE INVENTION

However, with the method described in Japanese Patent Application Laid-open No. 2010-181439, there has been a problem in the step of establishing a layer of a condensate of an organosilicon compound on the core particle surface, i.e., the organosilicon compound condensate adheres to the reaction vessel and continuous production is then problematic. Another problem has been that the toner may end up aggregating depending on the conditions for the aqueous medium, i.e., the temperature, pH, and so forth. Adherence of the organosilicon compound condensate to the reaction vessel and the impairment of continuous production has also been a problem in the step of obtaining the sol- or gel-state organosilicon compound-containing resin particles in the method disclosed as the fourth method in Japanese Patent Application Laid-open No. 2016-027399.

Thus, as indicated above, problems have occurred in the production by the emulsion aggregation method of a toner having an organosilicon compound condensate on the toner particle surface, i.e., continuous production has been made problematic by the adherence of the organosilicon compound condensate to the reaction vessel and the toner has undergone aggregation, and improvements have been required.

An object of the present invention is to solve the problems identified above. That is, an object is to inhibit toner aggregation and adherence of the organosilicon compound condensate to the reaction vessel in the method of producing a toner having an organosilicon compound condensate on the toner particle surface.

As a result of intensive and extensive investigations, the present inventors discovered that the problems identified above can be solved by the following constructions.

A first construction is a method of producing a toner comprising a toner particle, the toner particle containing:

a resin particle containing a binder resin, and a condensate of an organosilicon compound on a surface of the resin particle, this toner production method including a condensation step of condensing an organosilicon compound given by formula (1) below in a surfactant-containing aqueous medium, in which the resin particle is dispersed, to obtain the toner particle, wherein the surface tension of the aqueous medium in the condensation step is at least 35.0 mN/m:

$$Ra_{(n)}—Si—Rb_{(4-n)} \quad (1)$$

wherein, in formula (1), each Ra independently represents a halogen atom, a hydroxy group, or an alkoxy group; each Rb independently represents an alkyl group, an alkenyl group, an aryl group, an acyl group, or a methacryloxyalkyl group; and n represents an integer from 1 to 4.

A second construction is a method of producing a toner comprising a toner particle, the toner particle containing:

a resin particle containing a binder resin, and a condensate of an organosilicon compound on a surface of the resin particle, this toner production method including a condensation step of condensing an organosilicon compound given by formula (1) below in a surfactant-containing aqueous medium, in which the resin particle is dispersed, to obtain the toner particle, wherein the aqueous medium in the condensation step contains a metal salt containing an at least divalent metal ion, and the metal salt satisfies formula (2) below.

$$Ra_{(n)}—Si—Rb_{(4-n)} \quad (1)$$

In formula (1), each Ra independently represents a halogen atom, a hydroxy group, or an alkoxy group; each Rb independently represents an alkyl group, an alkenyl group, an aryl group, an acyl group, or a methacryloxyalkyl group; and n represents an integer from 1 to 4.

$$70.0 \leq A \times B \quad (2)$$

In formula (2), A represents the valence of the metal ion present in the metal salt and B represents the content (mmol/L) of the metal ion in the aqueous medium.

The present invention can thus inhibit toner aggregation and adherence of the organosilicon compound condensate to the reaction vessel in the method of producing a toner having an organosilicon compound condensate on the toner particle surface.

Further features of the present invention will become apparent from the following description of exemplary embodiments.

BRIEF DESCRIPTION OF THE DRAWINGS

Unless specifically indicated otherwise, expressions such as "from XX to YY" and "XX to YY" that show numerical value ranges refer in the present invention to numerical value ranges that include the lower limit and upper limit that are the end points.

The first aspect of the present invention is a method of producing a toner comprising a toner particle, the toner particle containing a resin particle containing a binder resin, and a condensate of an organosilicon compound on a surface of the resin particle, this toner production method including a condensation step of condensing an organosilicon compound given by formula (1) below in a surfactant-containing aqueous medium, in which the resin particle is dispersed, to obtain the toner particle, wherein the surface tension of the aqueous medium in the condensation step is at least 35.0 mN/m.

$$Ra_{(n)}—Si—Rb_{(4-n)} \quad (1)$$

(In formula (1), each Ra independently represents a halogen atom, a hydroxy group, or an alkoxy group; each Rb independently represents an alkyl group, an alkenyl group, an aryl group, an acyl group, or a methacryloxyalkyl group; and n represents an integer from 1 to 4.)

The second aspect of the present invention is a method of producing a toner comprising a toner particle, the toner particle containing a resin particle containing a binder resin, and a condensate of an organosilicon compound on a surface of the resin particle, this toner production method including a condensation step of condensing an organosilicon compound given by formula (1) below in a surfactant-containing aqueous medium, in which the resin particle is dispersed, to obtain the toner particle, wherein the aqueous medium in the condensation step contains a metal salt that contains an at least divalent metal ion and the metal salt satisfies formula (2) below.

$$Ra_{(n)}—Si—Rb_{(4-n)} \quad (1)$$

(In formula (1), each Ra independently represents a halogen atom, a hydroxy group, or an alkoxy group; each Rb independently represents an alkyl group, an alkenyl group, an aryl group, an acyl group, or a methacryloxyalkyl group; and n represents an integer from 1 to 4.)

$$70.0 \leq A \times B \quad (2)$$

(In formula (2), A represents the valence of the metal ion present in the metal salt and B represents the content (mmol/L) of the metal ion in the aqueous medium.)

These production methods can provide a toner having an organosilicon compound condensate on the toner particle surface and can do so while inhibiting toner aggregation and inhibiting adherence of the organosilicon compound condensate to the reactor vessel.

The present inventors carried out the following investigations in achieving the present invention.

First, the determination was made as to whether the organosilicon compound condensate would transfer to the resin particle when the resin particle was obtained by the emulsion aggregation method and the organosilicon compound was condensed in this aqueous medium. However, the organosilicon compound condensate did not transfer to the resin particle.

Based on the results of this investigation, the present inventors achieved the present invention reasoning as follows.

That is, one problem for the present invention is the difficulty of obtaining, in aqueous media as are used in the emulsion aggregation method, a toner having an organosilicon compound condensate on the toner particle surface. This problem is thought to arise due to the stability of the organosilicon compound condensate in the aqueous medium, which impedes transfer to the resin particle.

Thus, in order to induce the transfer of the organosilicon compound condensate to the resin particle surface, it would be effective to either destabilize the organosilicon compound condensate or to actively attract the organosilicon compound condensate to the vicinity of the resin particle surface.

As a result of focused investigations, the present inventors discovered, as a means for destabilizing the organosilicon compound condensate, a toner production method in which the surface tension of the aqueous medium is controlled, which is the first aspect of the present invention. The present inventors also discovered, as a means for attracting the organosilicon compound condensate to the vicinity of the resin particle surface, a toner production method in which the amount of multivalent metal ion in the aqueous medium is controlled, which is the second aspect of the present invention.

The toner production method in which the surface tension of the aqueous medium is controlled, which is the first aspect, is described first.

When a surfactant is present in the aqueous medium, the surfactant adsorbs to the resin particle and the organosilicon compound condensate and thereby stabilizes the resin particle and the organosilicon compound condensate. At this time, the ability of the organosilicon compound condensate to transfer to the resin particle is governed by the amount of surfactant in the aqueous medium and by the surfactancy of the surfactant. In addition, the amount of surfactant in the aqueous medium and the surfactancy of the surfactant can be estimated using the surface tension of the aqueous medium.

Specifically, a higher surface tension for the aqueous medium indicates a weaker action by the surfactant in the aqueous medium, and due to this the organosilicon compound condensate is destabilized and transfer to the resin particle surface then readily proceeds. When, on the other hand, the surface tension of the aqueous medium is raised, the resin particle itself may also end up being destabilized. Due to this, when toner is produced in an aqueous medium as in, for example, the emulsion aggregation method, this is generally carried out in an aqueous medium for which, in order to stabilize the resin particle, the surface tension has been reduced using surfactant, and has not heretofore been carried out under high surface tension conditions. That is, a trade-off relationship is presumed to occur when the surface tension of the aqueous medium is increased, i.e., transfer of the organosilicon compound condensate to the resin particle surface is facilitated, while resin particle aggregation is also facilitated.

However, as a result of focused investigations, the present inventors discovered that, when condensation of the organosilicon compound is carried out at the same time as transfer of the organosilicon compound condensate to the resin particle surface, resin particle-to-resin particle aggregation can be suppressed even when the surface tension of the aqueous medium is high. With regard to the mechanism for this, the present inventors hypothesize that the organosilicon compound condensate that has transferred to the resin particle surface inhibits resin particle-to-resin particle aggregation.

In order, on the other hand, to inhibit adherence by the organosilicon compound condensate to the reaction vessel, the aqueous medium must contain a surfactant. When a surfactant is present in the aqueous medium, the surfactant coats the interface between the reaction vessel and the aqueous medium. Adhesion of the organosilicon compound condensate to the reaction vessel can be inhibited by this.

More specifically, when the surface tension of the aqueous medium in the condensation step is 35.0 mN/m or more, due to a satisfactory transfer of the organosilicon compound condensate to the resin particle surface, resin particle-to-resin particle aggregation is inhibited while the toner particle can be obtained. Adherence of the organosilicon compound condensate to the reaction vessel can also be suppressed.

The surface tension of the aqueous medium is preferably at least 40.0 mN/m and is more preferably at least 45.0 mN/m. As the surface tension of the aqueous medium is increased, the organosilicon compound condensate can be induced to transfer to the resin particle surface at good efficiencies even when a small amount of organosilicon compound is used. In addition, from the perspective of inhibition of resin particle aggregation, the surface tension of the aqueous medium is preferably not more than 60.0 mN/m and is more preferably not more than 55.0 mN/m. For the present invention, the surface tension was measured on the resin particle-containing aqueous medium and this value was used as the surface tension of the aqueous medium.

The surface tension of the aqueous medium can be controlled through the type and concentration of the surfactant that is added to the aqueous medium.

The toner production method having a controlled amount of multivalent metal ion, which is the second aspect, will now be described.

Even when an organosilicon compound condensate is stable in an aqueous medium, when, in a disperse system of fine particles, the distance between particles falls below a certain level, the particle-to-particle attractive force becomes larger than the repulsive force. The organosilicon compound condensate then transfers to the resin particle surface as a consequence. However, the organosilicon compound condensate ordinarily has a negative charge, and, as a consequence, its approach to the surface of the similarly negatively charged resin particle is limited by a certain distance due to repulsion from the electric double layer. In contrast, if a positive charge can be imparted to the resin particle surface, transfer of the organosilicon compound condensate to the resin particle surface can then be induced.

The present inventors thought that a positive charge could be imparted to the resin particle surface through the formation of a salt between an at least divalent metal ion and functional groups, e.g., carboxylic acid, and sulfonic acid, on the resin particle surface. As a result of focused investigations, it was discovered that, by causing the presence in the aqueous medium of an at least divalent metal ion in at least a certain amount, a positive charge can be imparted to the resin particle surface and the organosilicon compound condensate then undergoes a satisfactory transfer to the resin particle surface.

It could be assumed that resin particle aggregation would also occur in this case due to a thinning of the electric double layer on the resin particle. However, it was discovered that resin particle aggregation could be inhibited when condensation of the organosilicon compound is carried out at the same time as transfer of the organosilicon compound condensate to the resin particle surface. With regard to the mechanism for this, the present inventors hypothesize that, just as with the first aspect, the organosilicon compound condensate that has transferred to the resin particle surface inhibits resin particle-to-resin particle aggregation.

Specifically, the product of A and B must satisfy formula (2) below when, in the condensation step, the aqueous medium contains a metal salt containing an at least divalent metal ion, A is the valence of the metal ion present in the metal salt, and B is the content (mmol/L) of the at least divalent metal ion in the aqueous medium. Here, "metal salt containing an at least divalent metal ion" is a metal salt that produces an at least divalent metal ion upon undergoing dissociation. In addition, "the aqueous medium contains a metal salt containing an at least divalent metal ion" is an expression that also encompasses the presence in the aqueous medium in a state of dissociation into the metal ion and its counterion.

$$70.0 \leq A \times B \quad (2)$$

When a plurality of metal ions are incorporated, A×B is calculated for each metal ion and these are then summed.

As a consequence of the preceding, the organosilicon compound condensate can satisfactorily transfer to the resin particle surface and a toner particle having the organosilicon compound condensate at its surface can then be obtained. The product of A and B is preferably at least 80.0 and is more preferably at least 100.0. As the product of A and B increases, the organosilicon compound condensate can be efficiently transferred to the resin particle surface even at smaller amounts of use of the organosilicon compound. As a result, the upper limit for the product of A and B is not particularly limited, but is preferably not more than 300.0 and more preferably not more than 200.0.

In order to impart a uniform positive charge to the resin particle surface, B is preferably from 20.0 mmol/L to 100.0 mmol/L. A water-soluble metal salt is generally used in order to bring B into the indicated range.

Viewed from the perspective of inhibiting resin particle aggregation, the surface tension of the aqueous medium is preferably not more than 60.0 mN/m and is more preferably not more than 55.0 mN/m.

With regard to the lower limit, on the other hand, the surface tension of the aqueous medium in the second aspect is preferably at least 25.0 mN/m and is more preferably at least 30.0 mN/m.

In order, on the other hand, to inhibit adherence by the organosilicon compound condensate to the reaction vessel, the aqueous medium must contain a surfactant. When a surfactant is present in the aqueous medium, the surfactant coats the interface between the reaction vessel and the aqueous medium. Adhesion of the organosilicon compound condensate to the reaction vessel can be inhibited by this.

Accordingly, the surfactant concentration in the aqueous medium in the condensation step is preferably from $1.0\times10^{-4}$ mass % to $1.0\times10^{1}$ mass %. From $1.0\times10^{-3}$ mass % to $5.0\times10^{0}$ mass % is more preferred. The surfactant can thoroughly coat the surface of the reaction vessel when the surfactant concentration is in the indicated range. A further inhibition of adhesion of the organosilicon compound condensate to the reaction vessel can then be achieved. The surfactant concentration indicated above is also preferred for the first aspect.

As has described above, a dispersion of a toner particle having an organosilicon compound condensate at its surface is obtained by inducing the transfer of the organosilicon compound condensate onto a resin particle via a step of condensing the organosilicon compound. This may be followed by processing the dispersion by filtration, washing, drying, and as necessary classification using known methods to obtain a toner particle. The toner particle may be used as such as a toner or may be used as a toner after the addition of an external additive, infra.

The pH in the condensation step is considered in the following.

While the pH of the condensation step may be considered a freely selectable condition, the condensation of the organosilicon compound can be influenced by the pH of the aqueous medium. As a consequence, the effects of the present invention can be further enhanced by controlling the pH of the aqueous medium.

Under acidic conditions, hydrolysis of the alkoxy group progresses electrophilically under proton catalysis, and as a consequence the hydrolysis of the alkoxy group in the molecule proceeds sequentially. Thus, the silanol group readily remains in the organosilicon compound condensate and the development of hydrophobicity is impeded. In addition, the occurrence of a three-dimensional condensation reaction is impeded as an increase in the molecular weight is impeded. On the other hand, under basic conditions, hydrolysis of the alkoxy group progresses nucleophilically under hydroxide ion catalysis, and as a consequence the hydrolysis of the alkoxy group in the molecule proceeds simultaneously. This works against the silanol group remaining in the organosilicon compound condensate, and the development of hydrophobicity is then facilitated. In addition, the occurrence of a three-dimensional condensation reaction is facilitated and an increase in the molecular weight is facilitated.

The higher the hydrophobicity of the organosilicon compound condensate, the lower its stability in the aqueous medium and the easier is its transfer to the resin particle, and the execution of the condensation step under basic conditions is therefore preferred. In addition, a higher molecular weight is more readily assumed by the organosilicon compound condensate when the condensation step is carried out under basic conditions, and as a consequence a reduction in the amount of organosilicon compound condensate dissolved in the aqueous medium is then made possible. The amount of the organosilicon compound condensate in the waste water may then be reduced, which is also preferred from the standpoint of reducing the load on waste water treatment. Moreover, the organosilicon compound condensate readily takes on a three-dimensional structure when the condensation step is carried out under basic conditions, and due to this the viscosity of the organosilicon compound condensate is lowered. Adhesion to the reaction vessel and resin particle-to-resin particle aggregation can therefore be inhibited still further.

In specific terms, the pH of the aqueous medium in the condensation step is preferably from 7.5 to 12.0 and is more preferably from 8.0 to 11.0.

The pH in the condensation step can be controlled using known acids and bases.

The acid used to adjust the pH can be exemplified by inorganic acids such as hydrochloric acid, sulfuric acid, nitric acid, boric acid, hydrofluoric acid, hydrobromic acid, permanganic acid, thiocyanic acid, phosphonic acid, phosphoric acid, diphosphoric acid, hexafluorophosphoric acid, tetrafluoroboric acid, and tripolyphosphoric acid, and by organic acids such as aspartic acid, o-aminobenzoic acid, p-aminobenzoic acid, isonicotinic acid, oxaloacetic acid, citric acid, 2-glycerol phosphate, glutamic acid, cyanoacetic acid, oxalic acid, trichloroacetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid, and malonic acid. These acids can be used without particular limitation. A single one of these acids may be used by itself, or two or more may be used in combination.

The base used to adjust the pH can be exemplified by alkali metals such as lithium, sodium, and potassium, and their aqueous solutions; alkali metal salts and their aqueous solutions; alkaline-earth metals such as calcium and magnesium and their aqueous solutions; alkaline-earth metal salts; ammonia; and urea-containing amines. Considered more specifically, this can be, for example, an aqueous solution of lithium hydroxide, an aqueous solution of sodium hydroxide, an aqueous solution of potassium hydroxide, an aqueous solution of calcium hydroxide, an aqueous solution of magnesium hydroxide, an aqueous solution of lithium carbonate, an aqueous solution of sodium carbonate, an aqueous solution of potassium carbonate, an aqueous ammonia solution, or urea. These bases can be used without particular limitation. In addition, a single one of these bases may be used by itself, or two or more may be used in combination.

The method of producing the resin particle is described in the following.

Known means can be used for the resin particle production method, and a kneading/pulverization method or a wet production method can be used. Wet production methods are preferred from the standpoints of the shape controllability and providing a uniform particle diameter. The wet production methods can be exemplified by the suspension polymerization method, dissolution suspension method, and emulsion aggregation method, with the use of the emulsion aggregation method being preferred. That is, the present invention preferably includes a step of obtaining resin particles by the aggregation, in an aqueous medium, of resin fine particles (latex particles) that contain the binder resin.

An example of production having the following steps (1) and (2) is provided as a specific example of resin particle production for the case of toner production by the emulsion aggregation method.

(1) a resin fine particle dispersion production step of producing a dispersion in which binder resin-containing resin fine particles are dispersed in an aqueous medium, by forming these resin fine particles by polymerization in the aqueous medium (2) a resin particle formation step of aggregating the resin fine particles in the aqueous medium to form resin particles in the aqueous medium These steps (1) and (2) are described in detail in the following.

(1) Resin Fine Particle Dispersion Production Step

Resin fine particles are formed in this resin fine particle dispersion production step and are supplied to the resin particle formation step.

Specifically, binder resin-containing resin fine particles may be obtained by the following method. A monomer solution is added to an aqueous medium containing surfactant at not more than the critical micelle concentration (CMC), wherein the monomer solution optionally contains internal additives, e.g., release agent, and charge control agent, dissolved or dispersed in the polymerizable monomer for forming the binder resin. Mechanical energy is applied thereto to bring about the formation of droplets, followed by the addition of a water-soluble radical polymerization initiator and the execution of a polymerization reaction in the droplets. An oil-soluble polymerization initiator may be incorporated in the droplets.

A forced emulsification process (droplet formation) may be carried out by the application of mechanical energy in such a binder resin polymerization step. Here, the means for applying this mechanical energy can be exemplified by means for applying vigorous stirring or ultrasound oscillation energy, e.g., homomixers, and ultrasound. When polyester resin fine particles are used as the resin fine particles, the polyester resin may be synthesized by a common polycondensation reaction and this may be finely particulated. The method for converting the polyester resin into a dispersion of fine particles can be exemplified by a method in which pulverization is carried out by a mechanical procedure and dispersion in an aqueous medium is carried out using a surfactant, a phase-inversion emulsification method, and so forth, but any method may be used in the present invention.

Known polymerizable monomers and polymerization initiators can be used as the polymerizable monomer and polymerization initiator when the resin fine particle dispersion is obtained by an emulsion polymerization method. The details are given below.

A known surfactant can be used when a surfactant is used in the resin fine particle dispersion production step. The details are given below.

In addition to the binder resin, the toner particle may optionally contain an internal additive, e.g., colorant, release agent, and charge control agent. Such an internal additive, for example, can be introduced into the toner particle in the resin fine particle dispersion production step by preliminary dissolution or dispersion in the monomer solution for forming the binder resin.

The internal additive may also be introduced into the toner particle by separately preparing a dispersion of internal additive fine particles that contain only the internal additive and inducing the aggregation of these internal additive fine particles with the resin fine particles in the resin particle formation step.

The materials described below in the sections on the constituent materials of the toner can be used as the internal additives referenced here.

(2) Resin Particle Formation Step

Fine particles of other toner constituent materials, e.g., colorant fine particles, release agent, charge control agent, and so forth, may optionally also be aggregated with the resin fine particles in this resin particle formation step.

The following method is provided as an example of a specific method for aggregating and fusing the resin fine particles and other internal additive fine particles. An aggregating agent is added at at least the critical aggregation concentration to the aqueous medium and heating is then carried out to a temperature that is at least the glass transition point of the resin fine particles and is not more than the melting peak temperature of their mixture. By doing this, salting out of the resin fine particles and fine particles added on an optional basis, such as colorant fine particles, is induced, while fusion is advanced in parallel at the same time. Once a desired particle diameter has been achieved, particle growth is halted by the addition of an aggregation inhibitor. As necessary, heating is continued in order to control the particle shape.

In this method, the holding time after the addition of the aggregating agent is preferably as short as possible and heating to the aforementioned prescribed temperature is preferably done rapidly. Doing this makes it possible to prevent the problem of fluctuations in the state of particle aggregation and inconsistencies in the particle diameter distribution and prevent the problem of fluctuations in the surface properties of the fused particle.

The time period until this heating is generally preferably within 30 minutes and is more preferably within 10 minutes. The ramp rate is preferably at least 1° C./minute. While the upper limit on the ramp rate is not particularly stipulated, it is preferably not more than 15° C./minute from the standpoint of suppressing the production of coarse particles due to the occurrence of rapid fusion. Moreover, after the reaction system has reached a temperature of at least the glass transition point, preferably fusion is continued by maintaining the aforementioned reaction system temperature for a certain period of time. By doing this, fusion and core particle growth can be effectively advanced and the durability of the ultimately obtained toner particle can be enhanced.

A known metal salt having an at least divalent metal ion can be used as the aggregating agent. The details are given below.

A known surfactant can be used in those instances in which a surfactant is used in the resin particle formation step. The details are given below.

The constituent materials of the toner of the present invention are described in the following.

Organosilicon Compound

An organosilicon compound given by formula (1) below is used in the present invention. Two or more organosilicon compounds may be used for this organosilicon compound as long as they have the structure given by formula (1).

$$Ra_{(n)}—Si—Rb_{(4-n)} \quad (1)$$

(In formula (1), each Ra independently represents a halogen atom, a hydroxy group, or an alkoxy group (preferably having 1 to 6 carbons); each Rb independently represents an alkyl group (preferably having 1 to 8 carbons), an alkenyl group (preferably having 1 to 8 carbons), an aryl group (preferably having 6 to 12 carbons), an acyl group (preferably having 1 to 8 carbons), or a methacryloxyalkyl group (preferably having an alkyl chain having 1 to 8 carbons); and n represents an integer from 1 to 4 (preferably 2 to 4).)

In the following, the Ra in formula (1) is referred to as a functional group and the Rb is referred to as a substituent.

A known organosilicon compound can be used without particular limitation as the organosilicon compound given by formula (1). The following monofunctional silane compounds having one functional group, difunctional silane compounds having two functional groups, trifunctional silane compounds having three functional groups, and tetrafunctional silane compounds having four functional groups are provided as specific examples.

The monofunctional silane compound can be exemplified by trimethylethoxysilane, triethylmethoxysilane, triethylethoxysilane, triisobutylmethoxysilane, triisopropylmethoxysilane, and tri-2-ethylhexylmethoxysilane.

The difunctional silane compound can be exemplified by dimethyldimethoxysilane and dimethyldiethoxysilane.

The trifunctional silane compound can be exemplified by the following:

trifunctional silane compounds having an alkyl group substituent, e.g., methyltrimethoxysilane, methyltriethoxysilane, methyldiethoxymethoxysilane, methylethoxydimethoxysilane, ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltrimethoxysilane, octyltriethoxysilane, decyltrimethoxysilane, and decyltriethoxysilane;

trifunctional silane compounds having an alkenyl group substituent, e.g., vinyltrimethoxysilane, vinyltriethoxysilane, allyltrimethoxysilane, and allyltriethoxysilane;

trifunctional silane compounds having an aryl group substituent, e.g., phenyltrimethoxysilane and phenyltriethoxysilane; and trifunctional silane compounds having a methacryloxyalkyl group substituent, e.g., γ-methacryloxypropyltrimethoxysilane, γ-methacryloxypropyltriethoxysilane, γ-methacryloxypropyldiethoxymethoxysilane, and γ-methacryloxypropylethoxydimethoxysilane.

The tetrafunctional silane compounds can be exemplified by tetramethoxysilane, tetraethoxysilane, tetrapropoxysilane, and tetrabutoxysilane.

Among the preceding, the difunctional, trifunctional, and tetrafunctional silane compounds can undergo conversion to a high molecular weight due to condensation and can thus form an organosilicon compound condensate of sufficient thickness on the toner particle and are therefore preferred.

Moreover, the trifunctional silane compounds undergo a three-dimensional condensation and in addition provide hydrophobing through their condensation, and as a consequence an organosilicon compound condensate having a high degree of crosslinking and a high hydrophobicity can be obtained. They thus enable the formation of a strong organosilicon compound condensate on the toner particle and at the same time can provide a reduced amount of organosilicon compound in the waste water and are therefore preferred.

Rb in formula (1) is preferably an alkyl group having 1 to 6 carbons, an alkenyl group having 1 to 6 carbons, an aryl group having 6 carbons, or the methacryloxypropyl group.

The organosilicon compound can be added and mixed into the aqueous medium in the condensation step using any method.

For example, the organosilicon compound may be added as such. In addition, it may be mixed with an aqueous medium and hydrolyzed and then added.

The organosilicon compound undergoes a condensation reaction after its hydrolysis. These two reactions have different optimal pH's. Due to this, the reactions may be effectively developed by preliminarily mixing the organosilicon compound with the aqueous medium separately from the resin particles and carrying out hydrolysis at a pH favorable for the hydrolysis reaction (preferably 1.0 to 7.0), followed by condensation, and this is thus preferred.

An organosilicon compound content, considered as the organosilicon compound condensate, in the range from 0.5 mass parts to 10.0 mass parts per 100.0 mass parts of the binder resin is preferably used.

Surfactant

A surfactant is used in the present invention. A known anionic surfactant, cationic surfactant, or nonionic surfactant can be used as this surfactant.

Specific examples of the anionic surfactant are alkyl sulfate esters such as sodium lauryl sulfate; polyoxyethylene alkyl ether sulfate ester salts such as sodium polyoxyethylene lauryl ether sulfate; sulfonate salts such as sodium dodecylbenzenesulfonate and sodium alkylnaphthalenesulfonate; and higher fatty acid salts such as sodium stearate and sodium laurate.

Specific examples of the cationic surfactant are quaternary ammonium salts such as dodecylammonium bromide, dodecyltrimethylammonium bromide, dodecylpyridinium chloride, dodecylpyridinium bromide, hexadecyltrimethylammonium bromide, lauryltrimethylammonium chloride, and alkylbenzyldimethylammonium chloride.

Specific examples of the nonionic surfactant are polyoxyethylene alkyl ethers such as polyoxyethylene lauryl ether and polyoxyethylene oleyl ether; polyoxyalkylene derivatives such as polyoxyethylenealkylene alkyl ethers; sorbitan/fatty acid esters such as sorbitan monolaurate and sorbitan monostearate; glycerol/fatty acid esters such as glycerol monostearate; and polyoxyethylene/fatty acid esters such as polyethylene glycol monolaurate.

Among the preceding, the use of anionic surfactants is preferred because they exhibit a large interaction with multivalent metal salts and further accelerate transfer of the organosilicon compound condensate to the resin particle.

Metal Salt Having an at Least Divalent Metal Ion

A metal salt having an at least divalent metal ion is used in the second aspect of the present invention. Such a metal salt may also be used in the first aspect.

The metal salt can be exemplified by the salts of trivalent aluminum, e.g., aluminum chloride ($AlCl_3$), aluminum sulfate ($Al_2(SO_4)_3$), aluminum hydroxide ($Al(OH)_3$), aluminum phosphate ($AlPO_4$), and polyaluminum chloride; the salts of trivalent and divalent iron, e.g., iron(III) chloride ($FeCl_3$), iron(III) sulfate ($Fe_2(SO_4)_3$), iron(III) hydroxide, iron(II) chloride ($FeCl_2$), iron(II) sulfate ($FeSO_4$), iron(II) hydroxide, iron polysulfate, and polysilica iron; salts of divalent magnesium, e.g., magnesium chloride ($MgCl_2$), magnesium sulfate ($MgSO_4$), and magnesium hydroxide ($Mg(OH)_2$); salts of divalent calcium, e.g., calcium chloride ($CaCl_2$), calcium sulfate ($CaSO_4$), tricalcium phosphate ($Ca_3(PO_4)_2$), hydrogen calcium phosphate ($CaHPO_4$), dihydrogen calcium phosphate ($Ca(H_2PO_4)_2$), calcium hydroxide ($Ca(OH)_2$), and hydroxyapatite ($Ca_{10}(PO_4)_6(OH)_2$); and salts of divalent cobalt, e.g., cobalt chloride ($CoC_{12}$) and cobalt sulfate ($CoSO_4$). Among the preceding, aluminum chloride, iron(III) chloride, magnesium chloride, calcium chloride, tricalcium phosphate ($Ca_3(PO_4)_2$), hydrogen calcium phosphate ($CaHPO_4$), dihydrogen calcium phosphate ($Ca(H_2PO_4)_2$), and hydroxyapatite ($Ca_{10}(PO_4)_6(OH)_2$) are preferred. The metal salt is preferably divalent or trivalent, with metal salts containing a trivalent metal ion being more preferred because they have a large interaction with the negatively charged organosilicon compound condensate and further promote transfer of the organosilicon compound condensate to the resin particle.

Binder Resin

The resin particle in the toner particle contains a binder resin.

The binder resin can be exemplified by vinyl resins, polyester resins, polyurethane resins, polyamide resins, furan resins, epoxy resins, xylene resins, and silicone resins.

The polymerizable monomer that can be used for vinyl resin synthesis can be exemplified by the following: styrenic monomers such as styrene and α-methylstyrene; acrylate esters such as methyl acrylate and butyl acrylate; methacrylate esters such as methyl methacrylate, 2-hydroxyethyl methacrylate, t-butyl methacrylate, and 2-ethylhexyl methacrylate; unsaturated carboxylic acids such as acrylic acid and methacrylic acid; unsaturated dicarboxylic acids such as maleic acid; unsaturated dicarboxylic acid anhydrides such as maleic anhydride; nitrile-type vinyl monomers such as acrylonitrile; halogen-containing vinyl monomers such as vinyl chloride; and nitro-type vinyl monomers such as nitrostyrene.

Polymerizable Monomer

Heretofore known monomers can be used without particular limitation for the polymerizable monomer used when the binder resin is obtained by the emulsion polymerization and aggregation method, the suspension polymerization method, and so forth.

The vinyl monomers given in the section on the binder resin are specific examples here.

Polymerization Initiator

A known polymerization initiator can be used without particular limitation as the polymerization initiator.

The following are specific examples: peroxide-type polymerization initiators as represented by e.g., hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl 1-hydroperoxide, tert-butyl triphenylperacetate, tert-butyl performate, tert-butyl peracetate, tert-butyl perbenzoate, tert-butyl phenylperacetate, tert-butyl methoxyperacetate, tert-butyl N-(3-toluyl)percarbamate, benzoyl peroxide, t-butyl peroxy-2-ethylhexanoate, t-butyl peroxypivalate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, and lauroyl peroxide, as well as azo- and diazo-type polymerization initiators as represented by e.g., 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Colorant

The toner particle may contain a colorant.

Heretofore known, for example, magnetic bodies and pigments and dyes that exhibit a black, yellow, magenta, cyan, or other color can be used without particular limitation as the colorant.

Specifically, for example, a black pigment as represented by, e.g., carbon black, may be used for the black colorant.

For yellow colorants, specific examples are yellow pigments and yellow dyes as represented by, for example, monoazo compounds, disazo compounds, condensed azo compounds, isoindolinone compounds, benzimidazolone compounds, anthraquinone compounds, azo metal complexes, methine compounds, and allylamide compounds. Examples at a more specific level are C. I. Pigment Yellow 74, 93, 95, 109, 111, 128, 155, 174, 180, and 185 and C. I. Solvent Yellow 162.

For magenta colorants, specific examples are magenta pigments and magenta dyes as represented by e.g., monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269 and C. I. Pigment Violet 19.

For cyan colorants, specific examples are copper phthalocyanine compounds and their derivatives, anthraquinone compounds; and cyan pigments and cyan dyes represented by, e.g., basic dye lake compounds. Examples at a more specific level are C. I. Pigment Blue 1, 7, 15, 15:1, 15:2, 15:3, 15:4, 60, 62, and 66.

The colorant content is preferably 1.0 to 20.0 mass parts per 100.0 mass parts of the binder resin or the polymerizable monomer that can produce the binder resin.

A magnetic toner may also be provided by the incorporation of a magnetic body in the toner. The magnetic body may also function as a colorant in this case. The magnetic body can be exemplified by iron oxides as represented by, e.g., magnetite, hematite, and ferrite; metals as represented by, e.g., iron, cobalt, and nickel; and alloys and mixtures of these metals with a metal such as aluminum, cobalt, copper, lead, magnesium, tin, zinc, antimony, beryllium, bismuth, cadmium, calcium, manganese, selenium, titanium, tungsten, and vanadium.

Release Agent

The toner particle may contain a release agent.

Specific examples are as follows: esters of a monohydric alcohol and a monocarboxylic acid, e.g., behenyl behenate, stearyl stearate, and palmityl palmitate; esters of a dibasic carboxylic acid and a monoalcohol, e.g., dibehenyl sebacate; esters of a dihydric alcohol and a monocarboxylic acid, e.g., hexanediol dibehenate; esters of a trihydric alcohol and a monocarboxylic acid, e.g., glycerol tribehenate; esters of a tetrahydric alcohol and a monocarboxylic acid, e.g., pentaerythritol tetrastearate and pentaerythritol tetrapalmitate; esters of a hexahydric alcohol and a monocarboxylic acid, e.g., dipentaerythritol hexastearate and dipentaerythritol hexapalmitate; esters of a multivalent alcohol and a monocarboxylic acid, e.g., polyglycerol behenate; natural ester waxes, e.g., carnauba wax and rice wax; petroleum-based hydrocarbon waxes, e.g., paraffin wax, microcrystalline wax, and petrolatum, and their derivatives; hydrocarbon waxes provided by the Fisher-Tropsch method and their derivatives; polyolefinic hydrocarbon waxes, e.g., polyethylene wax and polypropylene wax, and their derivatives; higher aliphatic alcohols; fatty acids such as stearic acid and palmitic acid; and acid amide waxes.

The content of the release agent, viewed from the standpoint of the releasability, is preferably 1.0 to 30.0 mass parts per 100.0 mass parts of the binder resin or the polymerizable monomer that can produce the binder resin. 5.0 to 20.0 mass parts is more preferred.

Charge Control Agent

The toner particle may contain a charge control agent.

The heretofore known charge control agents can be used without particular limitation as the charge control agent. Specific examples for negative charge control agents are metal compounds of aromatic carboxylic acids, e.g., salicylic acid, alkylsalicylic acid, dialkylsalicylic acid, naphthoic acid, and dicarboxylic acid; polymers and copolymers that contain a sulfonic acid group, a sulfonate salt group, or a sulfonate ester group; metal salts and metal complexes of azo dyes and azo pigments; as well as boron compounds, silicon compounds, and calixarene.

The positive charge control agent can be exemplified by quaternary ammonium salts and polymeric compounds that have a quaternary ammonium salt in side chain position; guanidine compounds; nigrosine compounds; and imidazole compounds.

The following can be used as a polymer or copolymer that contains a sulfonate salt group or a sulfonate ester group: homopolymers of a sulfonic acid group-bearing vinyl monomer, e.g., styrenesulfonic acid, 2-acrylamido-2-methylpropanesulfonic acid, 2-methacrylamido-2-methylpropanesulfonic acid, vinylsulfonic acid, and methacrylsulfonic acid;

and copolymers of these sulfonic acid group-bearing vinyl monomers and the vinyl monomers given above in the section on the binder resin.

The content of the charge control agent is preferably 0.01 to 5.0 mass parts per 100.0 mass parts of the binder resin or polymerizable monomer that can produce the binder resin.

External Additive

The toner, because it has the organosilicon compound condensate, exhibits excellent properties, such as an excellent flowability, even in the absence of external additive. However, an external additive may be used with the toner particle for the purpose of achieving additional improvements.

Heretofore known external additives can be used without particular limitation as the external additive here. Specific examples are as follows: virgin silica fine particles, e.g., wet silica, and dry silica, and the silica fine particles provided by the execution of a surface treatment on these virgin silica fine particles using a treatment agent such as a silane coupling agent, titanium coupling agent, and silicone oil; metal oxide fine particles, e.g., titanium oxide fine particles, aluminum oxide fine particles, zinc oxide fine particles, and strontium titanate fine particles, and the metal oxide fine particles provided by the execution of a hydrophobic treatment on these metal oxides; metal salts of fatty acids, e.g., calcium stearate, and zinc stearate; metal complexes of aromatic carboxylic acids such as salicylic acid, alkylsalicylic acid, dialkylsalicylic acid, naphthoic acid, and dicarboxylic acid; clay minerals such as hydrotalcite; and resin fine particles such as vinylidene fluoride fine particles and polytetrafluoroethylene fine particles.

The content of the external additive is preferably 0.1 to 5.0 mass parts per 100.0 mass parts of the toner particle.

EXAMPLES

The present invention is described in greater detail based on examples, but the present invention is not limited thereby. In the following formulations, parts is on a mass basis unless specifically indicated otherwise.

Resin Particle 1

Resin particle 1 was prepared using the emulsion aggregation method as follows.

(Preparation of a Binder Resin Fine Particle Dispersion)

80.0 parts of styrene, 18.7 parts of butyl acrylate, and 1.3 parts of acrylic acid as a monomer that provides the carboxy group, were mixed and dissolved. To this solution was added an aqueous solution of 4.0 parts of sodium dodecylbenzenesulfonate mixed in 150 parts of deionized water, and dispersion was carried out. An aqueous solution of 3.0 parts of potassium persulfate mixed in 10 parts of deionized water was then added over 10 minutes while gently stirring. After substitution with nitrogen, emulsion polymerization was carried out for 6 hours at 70° C. After completion of the polymerization, the reaction solution was cooled to room temperature, and deionized water was added to obtain a binder resin fine particle dispersion having a solids concentration of 20.0 mass % and a median diameter on a volume basis of 0.2 μm.

Preparation of a Polyester Resin Particle Dispersion

A jacketed 3-liter reaction vessel (BJ-30N, Tokyo Rikakikai Co., Ltd.) equipped with a condenser, thermometer, water dropwise addition apparatus, and anchor paddle was maintained at 40° C. in a water circulation-type thermostat. A mixed solvent of 160.0 parts of ethyl acetate and 100.0 parts of isopropyl alcohol was introduced into this reaction vessel; into this was introduced 300.0 parts of an amorphous polyester resin (condensate of terephthalic acid and propylene oxide-modified (2 mol adduct) bisphenol A, Mw: 7,800, Tg: 70° C., acid value: 8.0 mg KOH/g); and stirring was carried out at 150 rpm using a Three-One motor to effect dissolution and obtain an oil phase. Into this stirred oil phase was added dropwise 14.0 parts of a 10.0 mass % aqueous ammonia solution over a dropwise addition time of 5 minutes. After mixing for 10 minutes, 900.0 parts of deionized water was also added dropwise at a rate of 7.0 parts per minute to induce phase inversion and obtain an emulsion.

800.0 parts of the obtained emulsion was immediately introduced into a 2-liter recovery flask with 700.0 parts of deionized water, and this was set into an evaporator (Tokyo Rikakikai Co., Ltd.) connected to a vacuum control unit across a spherical trap. While rotating the recovery flask, heating was carried out on a 60° C. hot water bath and the solvent was removed by lowering the pressure to 7 kPa while taking care to avoid bumping. Recovery to normal pressure was performed when the amount of solvent recovery had reached 1,100.0 parts, and the recovery flask was cooled with water to obtain a dispersion. The obtained dispersion was free of solvent odor. The median diameter on a volume basis of the polyester resin fine particles in this dispersion was 130 nm. Deionized water was then added to adjust the solids concentration to 20.0 mass %, and this was used as the polyester resin fine particle dispersion.

Preparation of a Colorant Fine Particle Dispersion carbon black (Nipex 35, Orion Engineered Carbons LLC): 100.0 parts anionic surfactant, sodium dodecylbenzenesulfonate: 16.0 parts deionized water: 384.0 parts The preceding were mixed and dissolved and were dispersed for 60 minutes using an Ultimizer (HJP30006, Sugino Machine Co., Ltd.), a high-pressure countercollision-type disperser, to prepare a colorant fine particle dispersion in which the colorant was dispersed. The median diameter on a volume basis of the colorant fine particles in the colorant fine particle dispersion was 130 nm, and the colorant fine particle concentration was 20.0 mass %.

Preparation of a Release Agent Fine Particle Dispersion

Fischer-Tropsch wax (melting point: 78° C.): 100.0 parts anionic surfactant, sodium dodecylbenzenesulfonate: 16.0 parts deionized water: 384.0 parts These components were mixed, and the release agent was dissolved at an internal liquid temperature of 120° C. using a pressurized ejection-type homogenizer (Gaulin Homogenizer, Gaulin Co.). This was followed by dispersion processing for 120 minutes at a dispersion pressure of 5 MPa, then dispersion processing for 360 minutes at 40 MPa, and then cooling to obtain a release agent fine particle dispersion 1. The median diameter on a volume basis of the fine particles in this release agent fine particle dispersion was 225 nm. Deionized water was then added to adjust the solids concentration to 20.0 mass %.

Resin Particle Preparation binder resin fine particle dispersion: 500.0 parts polyester resin fine particle dispersion: 25.0 parts colorant fine particle dispersion: 40.0 parts release agent fine particle dispersion: 25.0 parts deionized water: 325.0 parts anionic surfactant, sodium dodecylbenzenesulfonate: 10.0 parts These components were introduced into a 3-liter reaction vessel equipped with a thermometer, pH meter, and stirrer, and the pH was brought to 3.0 at a temperature of 25° C. by the addition of 0.3 mol/L nitric acid. Then, while dispersing at 5,000 rpm using a homogenizer (Ultra-Turrax T50, IKA Japan KK), 130.0 parts of an aqueous aluminum chloride solution (0.3 mass %) was added and dispersion was carried out for 6 minutes.

A stirrer and a mantle heater were then installed on the reaction vessel, and the stirrer rotation rate was adjusted so the slurry was thoroughly stirred. While continuing to stir, heating was carried out to a temperature of 40° C. at a ramp rate of 0.2° C./minute; when 40° C. was exceeded, heating was carried out to 90° C. at a ramp rate of 0.05° C./minute; and a heat treatment process was performed for 180 minutes at 90° C. The vessel was subsequently cooled to 20° C. with cooling water.

After cooling, the slurry was passed through a nylon mesh having an aperture of 15 μm in order to remove the coarse powder; the resin particle dispersion that had passed through the mesh was adjusted to pH 6.0 by the addition of nitric acid; and vacuum filtration was performed using an aspirator. The resin particles remaining on the filter paper were manually broken up as finely as possible and were introduced into 10-fold 30° C. deionized water with respect to the amount of the toner. After stirring and mixing for 30 minutes, vacuum filtration was again performed using an aspirator and the conductivity of the filtrate was measured. The resin particles were washed by repeating this process until the conductivity of the filtrate dropped to 5 μS/cm or less.

After the washed resin particles had been finely milled using a wet-dry particle adjustment apparatus, vacuum drying was carried out for 36 hours in a 35° C. oven to obtain resin particle 1. The weight-average particle diameter (D4) of resin particle 1 was 6.48 μm. The weight-average particle diameter of resin particle 1 was measured based on Measurement of the Particle Diameter of the Resin Particles and Toner as follows.

Measurement of the Particle Diameter of the Resin Particles and Toner

A precision particle size distribution measurement instrument operating on the pore electrical resistance method (product name: Coulter Counter Multisizer 3) and its dedicated software (product name: Beckman Coulter Multisizer 3 Version 3.51, Beckman Coulter, Inc.) are used. The measurements are performed, the measurement data are analyzed, and the calculations are carried out using 100 μm for the aperture diameter and 25,000 channels for the number of effective measurement channels.

The aqueous electrolyte solution used for the measurements is prepared by dissolving special-grade sodium chloride in deionized water to provide a concentration of 1 mass % and, for example, ISOTON II (product name) from Beckman Coulter, Inc. can be used. The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using (standard particle 10.0 μm, Beckman Coulter, Inc.). The threshold value and noise level are automatically set by pressing the threshold value/noise level measurement button. In addition, the current is set to 1600 μA; the gain is set to 2; the electrolyte is set to ISOTON II (product name); and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) 30 mL of the above-described aqueous electrolyte solution is introduced into a 100-mL flatbottom glass beaker. To this is added 0.3 mL of a dilution prepared by the three-fold (mass) dilution with deionized water of Contaminon N (product name) (a 10 mass % aqueous solution of a neutral detergent for cleaning precision measurement instrumentation, Wako Pure Chemical Industries, Ltd.).

(3) A prescribed amount of deionized water and 2 mL of Contaminon N (product name) are introduced into the water tank of an ultrasound disperser having an electrical output of 120 W and two oscillators (oscillation frequency=50 kHz) disposed such that the phases are displaced by 180° (product name: Ultrasonic Dispersion System Tetora 150, Nikkaki Bios Co., Ltd.).

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the resin particles or toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner (particle)-containing aqueous electrolyte solution prepared in (5) is dripped into the roundbottom beaker set in the sample stand as described in (1) with adjustment to provide a measurement concentration of 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4). When set to graph/number % with the dedicated software, the "average diameter" on the "analysis/numerical statistical value (arithmetic average)" screen is the number-average particle diameter (D1).

Resin Particle 2

Resin particle 2 was prepared using the dissolution suspension method as follows.

Production of Release Agent Dispersion 100.0 parts of a Fischer-Tropsch wax (melting point=78° C.) pulverized to an average particle diameter of 20 μm was introduced into 100.0 parts of methanol; washing was performed by stirring for 10 minutes at a stirring rate of 150 rpm; and filtration was subsequently carried out. After this had been done three times, the release agent was recovered by filtration and drying. 100.0 parts of the obtained release agent and 100.0 parts of ethyl acetate were introduced into an attritor (Nippon Coke & Engineering Co., Ltd.) containing zirconia beads with a diameter of 20 mm, and dispersion was carried out for 120 minutes at 150 rpm. The zirconia beads were separated to obtain the release agent dispersion.

Production of Colorant Dispersion carbon black (Nipex 35, Orion Engineered Carbons LLC): 20.0 parts ethyl acetate: 80.0 parts These materials were introduced into an attritor (Nippon Coke & Engineering Co., Ltd.) containing zirconia beads with a diameter of 1.7 mm, and rotation was carried out for 300 minutes at a rotation rate of 200 rotations per minute. The zirconia beads were separated to obtain the colorant dispersion.

Production of a Resin Particle-Containing Aqueous Medium

The following were mixed to uniformity to form a toner composition.

ethyl acetate: 400.0 parts binder resin, styrene-n-butyl acrylate copolymer: 100.0 parts (styrene-n-butyl acrylate copolymerization ratio=80.0:20.0, Mp=22,000, Mw=35,000, Mw/Mn=2.4, Tg=60° C.)

amorphous polyester resin (condensate of terephthalic acid and propylene oxide-modified (2 mol adduct) bisphenol A, Mw=7,800, Tg=70° C., acid value=8.0 mg KOH/g): 5.0 parts release agent dispersion: 10.0 parts colorant dispersion: 40.0 parts 5.6 parts of sodium phosphate (dodecahydrate, RASA Industries, Ltd.) was introduced into 380.0 parts of deionized water in a reaction vessel, and this was held at 65° C. for 60 minutes while purging with nitrogen.

An aqueous calcium chloride solution of 3.6 parts of calcium chloride (dihydrate) dissolved in 20.0 parts of deionized water was added all at once while stirring at 12,000 rpm using a T. Komomixer (Tokushu Kika Kogyo Co., Ltd.) to prepare an aqueous medium containing a dispersion stabilizer. The aqueous medium was then obtained by introducing 10.0 mass % hydrochloric acid into the aqueous medium to adjust the pH to 6.0.

While holding this aqueous medium at 30° C. and maintaining a rotation rate of 12,000 rpm, the aforementioned toner composition was introduced into the aqueous medium and granulation was carried out for 2 minutes. 500.0 parts of deionized water was then introduced. After changeover to a common propeller stirrer, the aqueous medium was held at 30° C. to 35° C. and the stirrer rotation rate was brought to 150 rpm and the pressure within the vessel was reduced to 52 kPa and distillative removal was performed until the residual amount of ethyl acetate reached 200 ppm. The aqueous medium was then heated to 80° C. and a heat treatment was carried out for 30 minutes at 80° C. This was subsequently cooled to 25° C.

After cooling, the slurry was passed through a nylon mesh having an aperture of 15 μm in order to remove the coarse powder; the resin particle dispersion that had passed through the mesh was adjusted to pH 6.0 by the addition of nitric acid; and vacuum filtration was performed using an aspirator. The toner remaining on the filter paper was manually broken up as finely as possible and was introduced into 10-fold 30° C. deionized water with respect to the amount of the toner. After stirring and mixing for 30 minutes, vacuum filtration using an aspirator was again performed and the conductivity of the filtrate was measured. The resin particles were washed by repeating this process until the conductivity of the filtrate dropped to 5 μS/cm or less.

After the washed resin particles had been finely milled using a wet-dry particle adjustment apparatus, vacuum drying was carried out for 36 hours in a 35° C. oven to obtain resin particle 2. The weight-average particle diameter (D4) of resin particle 2 was 6.53 μm.

Resin Particle 3

Resin particle 3 was prepared using the suspension polymerization method as follows.

5.6 parts of sodium phosphate (dodecahydrate, RASA Industries, Ltd.) was introduced into 380.0 parts of deionized water in a reaction vessel, and this was held at 65° C. for 60 minutes while purging with nitrogen.

An aqueous calcium chloride solution of 3.6 parts of calcium chloride (dihydrate) dissolved in 20.0 parts of deionized water was introduced all at once while stirring at 12,000 rpm using a T. Komomixer (Tokushu Kika Kogyo Co., Ltd.) to prepare an aqueous medium containing a dispersion stabilizer. The aqueous medium was then obtained by introducing 10.0 mass % hydrochloric acid into the aqueous medium to adjust the pH to 6.0.

styrene: 60.0 parts carbon black (Nipex 35, Orion Engineered Carbons LLC): 8.0 parts These materials were introduced into an attritor (Nippon Coke & Engineering Co., Ltd.), and dispersion was performed for 5.0 hours at 220 rpm using zirconia particles having a diameter of 1.7 mm to prepare a pigment dispersion.

The following materials were added to this pigment dispersion.

styrene: 20.0 parts n-butyl acrylate: 20.0 parts amorphous polyester resin (condensate of terephthalic acid and propylene oxide-modified (2 mol adduct) bisphenol A, Mw: 7,800, Tg: 70° C., acid value: 8.0 mg KOH/g): 5.0 parts Fischer-Tropsch wax (melting point=78° C.): 5.0 parts This was held at 65° C., and dissolution and dispersion to uniformity was performed at 500 rpm using a T. Komomixer (Tokushu Kika Kogyo Co., Ltd.) to prepare a polymerizable monomer composition.

While holding the temperature of the aqueous medium at 70° C. and holding the rotation rate of the stirrer at 12,000 rpm, the polymerizable monomer composition was introduced into the aqueous medium and 7.0 parts of the polymerization initiator t-butyl peroxypivalate was added. Granulation was performed for 10 minutes in this state while maintaining 12,000 rpm with the aforementioned stirrer.

The stirring device was changed from the high-speed stirrer to a propeller stirring blade, and, while maintaining 70° C. while stirring at 150 rpm, a polymerization was run for 300 minutes. The temperature was raised to 85° C. and the polymerization reaction was run by heating for 120 minutes, and cooling to 25° C. was then performed.

After cooling, the slurry was passed through a nylon mesh having an aperture of 15 μm in order to remove the coarse powder; the resin particle dispersion that had passed through the mesh was adjusted to pH 6.0 by the addition of nitric acid; and vacuum filtration was then performed using an aspirator. The toner remaining on the filter paper was manually broken up as finely as possible and was introduced into 10-fold 30° C. deionized water with respect to the amount of the toner. After stirring and mixing for 30 minutes, vacuum filtration was again performed using an aspirator and the conductivity of the filtrate was measured.

The resin particles were washed by repeating this process until the conductivity of the filtrate dropped to 5 μS/cm or less.

After the washed resin particles had been finely milled using a wet-dry particle adjustment apparatus, vacuum drying was carried out for 36 hours in a 35° C. oven to obtain resin particle 3. The weight-average particle diameter (D4) of resin particle 3 was 6.50 μm.

Resin Particle 4

Resin particle 4 was prepared using a pulverization method as follows.

binder resin, styrene-n-butyl acrylate copolymer: 100.0 parts (styrene-n-butyl acrylate copolymerization ratio=80:20, Mp=22,000, Mw=35,000, Mw/Mn=2.4, Tg=60° C.)

carbon black (Nipex 35, Orion Engineered Carbons LLC): 8.0 parts

Fisher-Tropsch wax (melting point=78° C.): 10.0 parts

These materials were preliminarily mixed using an FM mixer (Nippon Coke & Engineering Co., Ltd.) followed by melt-kneading with a twin-screw kneader (Model PCM-30, Ikegai Ironworks Corporation) to obtain a kneaded material. The resulting kneaded material was cooled and was coarsely pulverized with a hammer mill (Hosokawa Micron Corporation) followed by pulverization with a mechanical pulverizer (T-250, Turbo Kogyo Co., Ltd.) to obtain a finely pulverized powder. The obtained finely pulverized powder was classified using a multi-grade classifier that utilized the Coanda effect (Model EJ-L-3, Nittetsu Mining Co., Ltd.) to obtain a resin particle 4. The weight-average particle diameter (D4) of resin particle 4 was 6.51 μm.

Resin Particle 5

A resin particle 5 was obtained proceeding as in the production method for resin particle 1, but without carrying out the washing step after vacuum filtration. The weight-average particle diameter (D4) of resin particle 5 was 6.48 μm.

Production of Resin Particle Dispersions

Resin Particle Dispersion 1

400.0 parts of deionized water was introduced into a reaction vessel. A surfactant (sodium dodecylbenzenesulfonate: DBSNa in the following) was added thereinto to provide a surfactant concentration of $2.5\times10^{-2}$ mass %. 100.0 parts of resin particle 1 was added thereinto, and dispersion was performed for 6 minutes at 5,000 rpm using a homogenizer (Ultra-Turrax T50, IKA Japan KK). The pH was then adjusted to 9.0 using a 1.0 N aqueous sodium hydroxide solution to obtain a resin particle dispersion 1. The surface tension of resin particle dispersion 1 was 50.2 mN/m.

The surface tension was measured at a temperature of 25° C. by the platinum plate method using an automatic surface tensiometer (product name: "DY-300", Kyowa Interface Science Co., Ltd.).

Resin Particle Dispersions 2 to 16, 33, and 34

Resin particle dispersions 2 to 16, 33, and 34 were obtained proceeding as in the production example for resin particle dispersion 1, but changing the combination of materials used, the surfactant concentration, and the pH of the aqueous medium as indicated in Table 1. The surface tension, surfactant concentration, and pH of the obtained resin particle dispersions are given in Table 1.

In the case of resin particle dispersion 16, surfactant was not added in the preparation of the resin particle dispersion, but the surface tension was lowered by the surfactant that remained on the resin particles. The surfactant concentration was estimated at $1.7\times10^{-2}$ mass % from the value for the surface tension.

Resin Particle Dispersion 17

400.0 parts of deionized water was introduced into a reaction vessel. A surfactant (sodium dodecylbenzenesulfonate: DBSNa in the following) and a metal salt (aluminum chloride hexahydrate) were added thereinto to provide a surfactant concentration of 1.0×10° mass % and a metal ion concentration of 40.0 mmol/L. 100.0 parts of resin particle 1 was added to this, and dispersion was performed at a temperature of 25° C. for 6 minutes at 5,000 rpm using a homogenizer (Ultra-Turrax T50, IKA Japan KK). The pH was then adjusted to 9.0 using a 1.0 N aqueous sodium hydroxide solution to obtain a resin particle dispersion 17.

Resin Particle Dispersions 18 to 31

Resin particle dispersions 18 to 31 were obtained proceeding as in the production example for resin particle dispersion 17, but changing the combination of materials used and the pH of the aqueous medium as indicated in Table 2. The metal ion concentration and pH of the obtained resin particle dispersions are given in Table 2. The metal ion concentration and pH for resin particle dispersions 33 and 34 are also given in Table 2.

Resin Particle Dispersion 32

The dispersion obtained after the 180-minute heat treatment at 90° C. and cooling in the production example for resin particle 1 was decanted to obtain a dispersion having a solids concentration of 20.0 mass %. To this dispersion was added a metal salt (aluminum chloride (hexahydrate)) to give a metal ion concentration of 40.0 mmol/L. The pH was then adjusted to 9.0 using a 1.0 N aqueous sodium hydroxide solution to obtain a resin particle dispersion 32.

Production of Organosilicon Compound Hydrolysis Solutions

Organosilicon Compound Hydrolysis Solution 1

80.0 parts of deionized water was metered into a reaction vessel equipped with a stirrer and a thermometer and the pH was adjusted to 3.0 using 10 mass % hydrochloric acid. Heating was then performed while stirring to bring the temperature to 70° C.

20.0 parts of methyltriethoxysilane was subsequently added and stirring was continued to obtain an organosilicon compound hydrolysis solution 1. The completion of hydrolysis was confirmed when the solution, which was separated into two phases at the start of methyltriethoxysilane addition, become one phase.

Organosilicon Compound Hydrolysis Solutions 2 to 10

Organosilicon compound hydrolysis solutions 2 to 10 were obtained proceeding as for the organosilicon compound hydrolysis solution 1, but changing the organosilicon compound as indicated in Table 3.

TABLE 1

| resin particle dispersion No. | resin particle | surfactant type | | surfactant concentration (mass %) | surface tension (mN/m) | pH |
|---|---|---|---|---|---|---|
| 1 | 1 | DBSNa | Anionic | $2.5\times10^{-2}$ | 50.2 | 9.0 |
| 2 | 1 | DBSNa | Anionic | $9.0\times10^{-2}$ | 37.3 | 9.0 |
| 3 | 1 | DBSNa | Anionic | $8.0\times10^{-2}$ | 41.8 | 9.0 |
| 4 | 1 | DBSNa | Anionic | $1.5\times10^{-2}$ | 58.5 | 9.0 |

TABLE 1-continued

| resin particle dispersion No. | resin particle | surfactant type | | surfactant concentration (mass %) | surface tension (mN/m) | pH |
|---|---|---|---|---|---|---|
| 5 | 1 | DBSNa | Anionic | $1.0 \times 10^{-2}$ | 61.7 | 9.0 |
| 6 | 1 | DBSNa | Anionic | $2.5 \times 10^{-2}$ | 50.5 | 7.2 |
| 7 | 1 | DBSNa | Anionic | $2.5 \times 10^{-2}$ | 50.3 | 8.0 |
| 8 | 1 | DBSNa | Anionic | $2.5 \times 10^{-2}$ | 49.8 | 11.0 |
| 9 | 1 | DBSNa | Anionic | $2.5 \times 10^{-2}$ | 49.5 | 12.5 |
| 10 | 1 | Emulgen 430 | Nonionic | $5.0 \times 10^{-5}$ | 61.8 | 9.0 |
| 11 | 1 | Emulgen 430 | Nonionic | $2.0 \times 10^{-4}$ | 58.0 | 9.0 |
| 12 | 2 | DBSNa | Anionic | $2.5 \times 10^{-2}$ | 50.3 | 9.0 |
| 13 | 3 | DBSNa | Anionic | $2.5 \times 10^{-2}$ | 50.1 | 9.0 |
| 14 | 4 | DBSNa | Anionic | $2.5 \times 10^{-2}$ | 50.1 | 9.0 |
| 15 | 4 | Emulgen 430 | Nonionic | $1.0 \times 10^{0}$ | 47.0 | 9.0 |
| 16 | 5 | DBSNa | Anionic | $1.7 \times 10^{-2}$ | 56.2 | 9.0 |
| 33 | 1 | DBSNa | Anionic | $1.0 \times 10^{0}$ | 32.8 | 9.0 |
| 34 | 1 | — | — | — | 70.2 | 9.0 |

Emulgen 430 from Kao Corporation was used for the Emulgen 430 in the table.

TABLE 2

| resin particle dispersion No. | resin particle | surfactant type | | surfactant concentration (mass %) | metal salt type | valence A | concentration B (mmol/l) | A × B | surface tension (mN/m) | pH |
|---|---|---|---|---|---|---|---|---|---|---|
| 17 | 1 | DBSNa | anionic | $1.0 \times 10^{0}$ | aluminum chloride | 3 | 40.0 | 120.0 | 32.3 | 9.0 |
| 18 | 1 | DBSNa | anionic | $1.0 \times 10^{0}$ | aluminum chloride | 3 | 28.0 | 84.0 | 31.5 | 9.0 |
| 19 | 1 | DBSNa | anionic | $1.0 \times 10^{0}$ | aluminum chloride | 3 | 25.0 | 75.0 | 31.3 | 9.0 |
| 20 | 1 | DBSNa | anionic | $1.0 \times 10^{0}$ | aluminum chloride | 3 | 60.0 | 180.0 | 33.4 | 9.0 |
| 21 | 1 | Sanisol B50 | cationic | $1.0 \times 10^{1}$ | aluminum chloride | 3 | 40.0 | 120.0 | 31.5 | 7.2 |
| 22 | 1 | Sanisol B50 | cationic | $1.0 \times 10^{1}$ | aluminum chloride | 3 | 40.0 | 120.0 | 32.0 | 8.0 |
| 23 | 1 | Sanisol B50 | cationic | $1.0 \times 10^{1}$ | aluminum chloride | 3 | 40.0 | 120.0 | 32.4 | 11.0 |
| 24 | 1 | Sanisol B50 | cationic | $1.0 \times 10^{1}$ | aluminum chloride | 3 | 40.0 | 120.0 | 33.5 | 12.5 |
| 25 | 1 | DBSNa | anionic | $1.0 \times 10^{0}$ | iron(III) chloride | 3 | 40.0 | 120.0 | 32.4 | 9.0 |
| 26 | 1 | DBSNa | anionic | $1.0 \times 10^{0}$ | magnesium chloride | 2 | 60.0 | 120.0 | 31.0 | 9.0 |
| 27 | 1 | DBSNa | anionic | $1.0 \times 10^{0}$ | calcium chloride | 2 | 60.0 | 120.0 | 31.2 | 9.0 |
| 28 | 2 | DBSNa | anionic | $1.0 \times 10^{0}$ | calcium chloride | 2 | 60.0 | 120.0 | 31.3 | 9.0 |
| 29 | 3 | DBSNa | anionic | $1.0 \times 10^{0}$ | calcium chloride | 2 | 60.0 | 120.0 | 31.2 | 9.0 |
| 30 | 4 | DBSNa | anionic | $1.0 \times 10^{0}$ | calcium chloride | 2 | 60.0 | 120.0 | 31.5 | 9.0 |
| 31 | 4 | Emulgen 430 | nonionic | $1.0 \times 10^{0}$ | tricalcium phosphate | 2 | 60.0 | 120.0 | 47.0 | 9.0 |
| 32 | — | DBSNa | anionic | $1.2 \times 10^{0}$ | aluminum chloride | 3 | 40.0 | 120.0 | 30.7 | 9.0 |
| 33 | 1 | DBSNa | anionic | $1.0 \times 10^{0}$ | aluminum chloride | 3 | 3.1 | 9.3 | 32.8 | 9.0 |
| 34 | 1 | — | — | — | aluminum chloride | 3 | 3.1 | 9.3 | 70.2 | 9.0 |

Sanisol B50 from Kao Corporation was used for the Sanisol B50, and Emulgen 430 from Kao Corporation was used for the Emulgen 430 in the table.

TABLE 3

| hydrolysis solution No. | organosilicon compound | number of functional groups |
|---|---|---|
| 1 | methyltriethoxysilane | 3 |
| 2 | isobutyltrimethoxysilane | 3 |
| 3 | hexyltrimethoxysilane | 3 |
| 4 | vinyltriethoxysilane | 3 |
| 5 | propyltrimethoxysilane | 3 |
| 6 | dimethyldiethoxysilane | 2 |
| 7 | tetraethoxysilane | 4 |
| 8 | trimethylethoxysilane | 1 |
| 9 | phenyltrimethoxysilane | 3 |
| 10 | ethyltriethoxysilane | 3 |

Toner Production Examples

Example 1

100.0 parts of resin particle dispersion 1 was metered into a reaction vessel and was heated to 70° C. while stirring. To this was added 6.0 parts of the organosilicon compound hydrolysis solution 1, which had been adjusted to pH 9.0 with a 1 mol/L aqueous NaOH solution, and the condensation step was carried out by stirring for 240 minutes.

The particles and filtrate were then separated by filtration using Kiriyama filter paper (No. 5C: pore diameter=1 μm). The resulting particles were washed with 100 parts of deionized water and were vacuum dried for 24 hours at 25° C. to yield toner 1.

Examples 2 to 19 and 22 to 40 and Comparative Examples 1 and 2

The toners of Examples 2 to 19 and 22 to 40 and Comparative Examples 1 and 2 were obtained proceeding as in Example 1, but changing the resin particle dispersion and organosilicon compound hydrolysis solution as shown in Table 4. The pH of the hydrolysis solution was adjusted immediately prior to introduction to be the same as the pH of the resin particle dispersion, followed by use.

Example 20

100.0 parts of the resin particle dispersion 1 was metered into a reaction vessel and was heated to 80° C. while stirring. To this were added 1.0 parts of colloidal silica (number-average particle diameter=80 nm, solids fraction=40.0 mass %) and 2.0 parts of organosilicon compound hydrolysis solution 9, which had been adjusted to pH 9.0 with a 1 mol/L aqueous NaOH solution, and the condensation step was performed by stirring for 240 minutes.

The particles and filtrate were then separated by filtration using Kiriyama filter paper (No. 5C: pore diameter=1 μm). The resulting particles were washed with 100 parts of deionized water and were vacuum dried for 24 hours at 25° C. to yield toner 20.

Examples 21, 41, and 42 and Comparative Example 3

The toners of Examples 21, 41, and 42 and Comparative Example 3 were obtained proceeding as in Example 20, but changing the resin particle dispersion and organosilicon compound hydrolysis solution as in Table 4. The pH of the hydrolysis solution was adjusted immediately prior to introduction to be the same as the pH of the resin particle dispersion, followed by use.

Evaluations

The toners (toners 1 to 45) obtained in the examples and comparative examples and the filtrates obtained during their production were evaluated using the following methods. The results are given in Table 4.

Amount of Organosilicon Compound Condensate in the Toner

The organosilicon compound condensate in the toner was evaluated using the following method.

Measurement of the amount of silicon compound is carried out using an "Axios" wavelength-dispersive x-ray fluorescence analyzer (PANalytical B.V.) and the "SuperQ ver. 4.0F" (PANalytical B.V.) software provided with the instrument in order to set the measurement conditions and analyze the measurement data. Rh is used for the x-ray tube anode; a vacuum is used for the measurement atmosphere; the measurement diameter (collimator mask diameter) is 27 mm; and the measurement time is 10 seconds. Detection is carried out with a proportional counter (PC) in the case of measurement of the light elements, and with a scintillation counter (SC) in the case of measurement of the heavy elements.

4 g of the toner is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm and a diameter of 39 mm by compression for 60 seconds at 20 MPa, and this pellet is used as the measurement sample.

0.5 parts of silica ($SiO_2$) fine powder is added to 100 parts of the resin particles that lack the organosilicon condensate, and thorough mixing is performed using a coffee mill. 5.0 parts and 10.0 parts of the silica fine powder are each likewise mixed with the resin particles, and these are used as samples for construction of a calibration curve.

For each of these samples, a pellet of the sample for calibration curve construction is fabricated proceeding as above using the tablet compression molder, and the count rate (unit: cps) is measured for the Si—Kα radiation observed at a diffraction angle (2θ)=109.08° using PET for the analyzer crystal. In this case, the acceleration voltage and current value for the x-ray generator are, respectively, 24 kV and 100 mA. A calibration curve in the form of a linear function is obtained by placing the obtained x-ray count rate on the vertical axis and the amount of $SiO_2$ addition in each calibration curve sample on the horizontal axis. The toner to be analyzed is then made into a pellet proceeding as above using the tablet compression molder and is subjected to measurement of its Si—Kα radiation count rate. The amount of organosilicon compound condensate in the toner is determined from the aforementioned calibration curve.

Evaluation Criteria

A: the amount of organosilicon compound condensate in the toner is at least 1.0 mass %

B: the amount of organosilicon compound condensate in the toner is at least 0.8 mass % and less than 1.0 mass %

C: the amount of organosilicon compound condensate in the toner is at least 0.5 mass % and less than 0.8 mass %

D: the amount of organosilicon compound condensate in the toner is less than 0.5 mass %

Amount of Silicon Compound in the Filtrate

The amount of silicon compound in the filtrate was evaluated using the following method.

The obtained filtrate was filtered across a "Sample Pretreatment Cartridge" solvent-resistant membrane filter with a pore diameter of 0.2 μm (Tosoh Corporation) to provide the sample solution. The amount of silicon compound in the sample solution was measured by the following method and was used as the amount of silicon compound in the filtrate.

The silicon intensity was quantitated as the fluorescence x-ray intensity using an Axios x-ray fluorescence analyzer (PANalytical B.V.) and the "SuperQ ver. 4.0F" (PANalytical B.V.) software provided with the instrument in order to set the measurement conditions and analyze the measurement data.

A P2 plastic liquid sample cup (PANalytical B.V.) was used as the sample cup, and a 6.0 μ-Mylar film (PANalytical B.V.) was used as the liquid cup film. Exactly 3 mL of the sample is introduced into the sample cup assembled with the liquid cup film, and measurement with the Axios x-ray fluorescence analyzer is carried out to obtain the net intensity for the silicon present in the sample. Rh is used for the x-ray tube anode; helium is used for the measurement atmosphere; the measurement diameter (collimator mask diameter) is 27 mm; and the measurement time is 10 seconds. Detection is carried out with a proportional counter (PC) in the case of measurement of the light elements, and with a scintillation counter (SC) in the case of measurement of the heavy elements.

To carry out quantitation, hydrolysis solutions were prepared at concentrations of 0.1 mass %, 0.5 mass %, 1.0 mass %, and 2.0 mass % for each of the organosilicon compounds, and a calibration curve was constructed by measurement by the measurement method described above. The amount of silicon compound in the filtrate was quantitated using this calibration curve and the value measured for the particular sample solution.

Evaluation Criteria

A: the amount of silicon compound in the filtrate is not more than 0.5 mass %

B: the amount of silicon compound in the filtrate exceeds 0.5 mass % and is not more than 0.8 mass %

C: the amount of silicon compound in the filtrate exceeds 0.8 mass % and is not more than 1.3 mass %

D: the amount of silicon compound in the filtrate exceeds 1.3 mass %

Adherence to the Reaction Vessel

Adherence to the reaction vessel was evaluated using the following method.

Toner production according to the particular example or comparative example was carried out three times consecutively using the same vessel; the status of adhesion by the organosilicon compound condensate to the reaction vessel and stirring blades was inspected after toner production; and evaluation was carried out using the following criteria.

Evaluation Criteria

A: no deposits are present even after three production cycles

B: sticky deposits are present to a minor degree after three production cycles

C: sticky deposits are present to a minor degree after one production cycle

D: sticky deposits are present in large amounts after one production cycle

Toner Aggregation

Toner aggregation was evaluated using the following method.

Toner aggregation in the condensation step was evaluated using the value in formula (4) below where D4T is the weight-average particle diameter of the toner and D4J is the weight-average particle diameter of the resin particle.

$$D4T/D4J \quad (4)$$

Evaluation Criteria

A: the value of formula (4) is not more than 1.10

B: the value of formula (4) exceeds 1.10 and is not more than 1.20

C: the value of formula (4) exceeds 1.20 and is not more than 1.30

D: the value of formula (4) exceeds 1.30

TABLE 4

| | toner | resin particle dispersion | hydrolysis solution | amount of silicon compound in the toner | | amount of silicon compound in the filtrate | | adherence to reaction vessel | toner aggregation | |
|---|---|---|---|---|---|---|---|---|---|---|
| Example 1 | 1 | 1 | 1 | A | 1.5 | A | 0.4 | A | A | 1.05 |
| Example 2 | 2 | 2 | 2 | B | 0.9 | A | 0.5 | A | A | 1.02 |
| Example 3 | 3 | 3 | 2 | A | 1.2 | A | 0.4 | A | A | 1.03 |
| Example 4 | 4 | 4 | 3 | A | 1.8 | A | 0.2 | A | A | 1.06 |
| Example 5 | 5 | 5 | 3 | A | 1.8 | A | 0.2 | A | C | 1.23 |
| Example 6 | 6 | 6 | 1 | B | 0.9 | C | 0.9 | B | B | 1.12 |
| Example 7 | 7 | 7 | 4 | A | 1.6 | A | 0.3 | A | A | 1.03 |
| Example 8 | 8 | 8 | 5 | A | 1.7 | A | 0.2 | A | A | 1.06 |
| Example 9 | 9 | 9 | 1 | A | 1.2 | B | 0.6 | A | A | 1.05 |
| Example 10 | 10 | 10 | 1 | B | 0.9 | B | 0.7 | C | A | 1.06 |
| Example 11 | 11 | 11 | 1 | B | 0.9 | B | 0.7 | A | A | 1.08 |
| Example 12 | 12 | 1 | 6 | B | 0.9 | B | 0.8 | A | A | 1.05 |
| Example 13 | 13 | 1 | 7 | B | 0.9 | B | 0.8 | A | A | 1.06 |
| Example 14 | 14 | 1 | 8 | C | 0.6 | C | 1.0 | A | A | 1.05 |
| Example 15 | 15 | 12 | 1 | A | 1.5 | A | 0.4 | A | A | 1.03 |
| Example 16 | 16 | 13 | 1 | A | 1.5 | A | 0.4 | A | A | 1.02 |
| Example 17 | 17 | 14 | 1 | A | 1.5 | A | 0.4 | A | A | 1.08 |
| Example 18 | 18 | 15 | 1 | A | 1.5 | A | 0.4 | A | A | 1.02 |
| Example 19 | 19 | 16 | 1 | A | 1.5 | A | 0.4 | A | A | 1.05 |
| Example 20 | 20 | 1 | 9 | A | 1.2 | A | 0.4 | A | A | 1.05 |
| Example 21 | 21 | 1 | 1 | A | 1.4 | A | 0.2 | A | A | 1.05 |
| Example 22 | 22 | 17 | 1 | A | 1.5 | A | 0.4 | A | A | 1.05 |
| Example 23 | 23 | 18 | 1 | A | 1.3 | A | 0.4 | A | A | 1.03 |
| Example 24 | 24 | 19 | 1 | B | 0.9 | A | 0.4 | A | A | 1.02 |
| Example 25 | 25 | 20 | 1 | A | 1.6 | A | 0.4 | A | A | 1.06 |
| Example 26 | 26 | 21 | 1 | C | 0.6 | C | 0.9 | B | B | 1.13 |
| Example 27 | 27 | 22 | 10 | B | 0.9 | B | 0.6 | A | A | 1.03 |
| Example 28 | 28 | 23 | 4 | B | 0.9 | B | 0.6 | A | A | 1.06 |
| Example 29 | 29 | 24 | 1 | B | 0.8 | B | 0.8 | A | A | 1.05 |
| Example 30 | 30 | 17 | 6 | B | 0.9 | B | 0.8 | A | A | 1.05 |
| Example 31 | 31 | 17 | 7 | B | 0.9 | B | 0.8 | A | A | 1.06 |
| Example 32 | 32 | 17 | 8 | C | 0.6 | C | 1.0 | A | A | 1.03 |
| Example 33 | 33 | 25 | 1 | A | 1.5 | A | 0.4 | A | A | 1.06 |
| Example 34 | 34 | 26 | 1 | B | 0.9 | A | 0.5 | A | A | 1.06 |
| Example 35 | 35 | 27 | 1 | B | 0.9 | A | 0.5 | A | A | 1.06 |
| Example 36 | 36 | 28 | 1 | B | 0.9 | A | 0.5 | A | A | 1.03 |
| Example 37 | 37 | 29 | 1 | B | 0.9 | A | 0.5 | A | A | 1.02 |
| Example 38 | 38 | 30 | 1 | B | 0.9 | A | 0.5 | A | A | 1.08 |
| Example 39 | 39 | 31 | 1 | A | 1.5 | A | 0.4 | A | A | 1.05 |
| Example 40 | 40 | 32 | 1 | A | 1.5 | A | 0.4 | A | A | 1.02 |
| Example 41 | 41 | 17 | 9 | A | 1.2 | A | 0.4 | A | A | 1.05 |
| Example 42 | 42 | 17 | 1 | A | 1.4 | A | 0.2 | A | A | 1.05 |
| Comparative 1 | 43 | 33 | 2 | D | 0.1 | D | 1.4 | A | A | 1.02 |
| Comparative 2 | 44 | 34 | 2 | A | 1.5 | A | 0.3 | D | D | 1.38 |
| Comparative 3 | 45 | 33 | 9 | D | 0.1 | A | 0.5 | A | A | 1.02 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-96524, filed May 15, 2017, and Japanese Patent Application No. 2018-71287, filed Apr. 3, 2018, which are hereby incorporated by reference herein in their entirety.

What is claimed is:

1. A method of producing a toner comprising a toner particle, the toner particle containing:

a resin particle containing a binder resin, and a condensate of an organosilicon compound on a surface of the resin particle, the toner production method comprising:

a condensation step of condensing an organosilicon compound given by formula (1) below in a surfactant-containing aqueous medium, in which the resin particle is dispersed, to obtain the toner particle, wherein a surface tension of the aqueous medium in the condensation step is at least 35.0 mN/m:

$$Ra_{(n)}—Si—Rb_{(4-n)} \quad (1)$$

wherein, in formula (1), each Ra independently represents a halogen atom, a hydroxy group, or an alkoxy group; each Rb independently represents an alkyl group, an alkenyl group, an aryl group, an acyl group, or a methacryloxyalkyl group; and n represents an integer from 1 to 4.

2. The toner production method according to claim 1, wherein the surface tension of the aqueous medium in the condensation step is not more than 60.0 mN/m.

3. The toner production method according to claim 1, wherein n in formula (1) is an integer from 2 to 4.

4. The toner production method according to claim 1, wherein pH of the aqueous medium in the condensation step is from 7.5 to 12.0.

5. The toner production method according to claim 1, comprising a step of obtaining the resin particle by aggregating, in the aqueous medium, resin fine particles that contain the binder resin.

6. The toner production method according to claim 1, wherein concentration of the surfactant in the aqueous medium in the condensation step is from $1.0\times10^{-4}$ mass % to $1.0\times10^{1}$ mass %.

7. The toner production method according to claim 1, wherein, in formula (1), each Ra independently represents a halogen atom, a hydroxy group, or an alkoxy group having 1 to 6 carbons, and each Rb independently represents an alkyl group having 1 to 8 carbons, an alkenyl group having 1 to 8 carbons, an aryl group having 6 to 12 carbons, an acyl group having 1 to 8 carbons, or a methacryloxyalkyl group having an alkyl chain having 1 to 8 carbons.

8. A method of producing a toner comprising a toner particle, the toner particle containing:

a resin particle containing a binder resin, and a condensate of an organosilicon compound on a surface of the resin particle, the toner production method comprising:

a condensation step of condensing an organosilicon compound given by formula (1) below in a surfactant-containing aqueous medium, in which the resin particle is dispersed, to obtain the toner particle, wherein the aqueous medium in the condensation step contains a metal salt containing an at least divalent metal ion, and the metal salt satisfies formula (2) below:

$$Ra_{(n)}—Si—Rb_{(4-n)} \quad (1)$$

wherein, in formula (1), each Ra independently represents a halogen atom, a hydroxy group, or an alkoxy group; each Rb independently represents an alkyl group, an alkenyl group, an aryl group, an acyl group, or a methacryloxyalkyl group; and n represents an integer from 1 to 4; and $$70.0 \leq A \times B \quad (2)$$

wherein, in formula (2), A represents the valence of the metal ion present in the metal salt and B represents the content (mmol/L) of the metal ion in the aqueous medium.

9. The toner production method according to claim 8, wherein the surface tension of the aqueous medium in the condensation step is not more than 60.0 mN/m.

10. The toner production method according to claim 8, wherein n in formula (1) is an integer from 2 to 4.

11. The toner production method according to claim 8, wherein pH of the aqueous medium in the condensation step is from 7.5 to 12.0.

12. The toner production method according to claim 8, comprising a step of obtaining the resin particle by aggregating, in the aqueous medium, resin fine particles that contain the binder resin.

13. The toner production method according to claim 8, wherein concentration of the surfactant in the aqueous medium in the condensation step is from $1.0\times10^{-4}$ mass % to $1.0\times10^{1}$ mass %.

14. The toner production method according to claim 8, wherein, in formula (1), each Ra independently represents a halogen atom, a hydroxy group, or an alkoxy group having 1 to 6 carbons, and each Rb independently represents an alkyl group having 1 to 8 carbons, an alkenyl group having 1 to 8 carbons, an aryl group having 6 to 12 carbons, an acyl group having 1 to 8 carbons, or a methacryloxyalkyl group having an alkyl chain having 1 to 8 carbons.

* * * * *